United States Patent [19]

Bayerlein et al.

[11] 4,368,324

[45] Jan. 11, 1983

[54] SIZING AGENT AND PROCESS FOR THE MANUFACTURE THEREOF

[75] Inventors: Friedrich J. Bayerlein; Peter P. Habereder, both of Krailling; Maria Denkler, Munich; Nikolaos Keramaris, Eichenau, all of Fed. Rep. of Germany

[73] Assignee: Diamalt Aktiengesellschaft, Munich, Fed. Rep. of Germany

[21] Appl. No.: 253,487

[22] Filed: Apr. 13, 1981

[30] Foreign Application Priority Data

Apr. 29, 1980 [DE] Fed. Rep. of Germany ..... 3016561

[51] Int. Cl.[3] ..... C08B 37/00; D06M 15/04

[52] U.S. Cl. ..... 536/114; 8/115.6; 536/120

[58] Field of Search ..... 536/120, 114; 8/115.6

[56] References Cited

U.S. PATENT DOCUMENTS

| | | | |
|---|---|---|---|
| 2,477,544 | 7/1949 | Moe | 536/114 |
| 2,599,771 | 6/1952 | Moe | 536/114 |
| 3,326,890 | 6/1967 | Engelskirchen et al. | 536/114 |
| 3,350,386 | 10/1967 | Engelskirchen et al. | 536/120 |

FOREIGN PATENT DOCUMENTS

| | | | |
|---|---|---|---|
| 475836 | 5/1975 | Australia | 536/114 |
| 494644 | 7/1953 | Canada | 536/114 |
| 497392 | 11/1953 | Canada | 536/114 |
| 505958 | 9/1954 | Canada | 536/114 |
| 834375 | 5/1960 | United Kingdom | 536/114 |

*Primary Examiner*—Ronald W. Griffin

*Attorney, Agent, or Firm*—Morgan, Finnegan, Pine, Foley & Lee

[57] ABSTRACT

A sizing agent for yarns made of cotton, regenerated cellulose and synthetic fibers and their mixture. The sizing agent substantially comprises a hydroxyalkylated polysaccharide from the seed of *Cassia occidentalis.* The polysaccharide has a viscosity of from 40 to 10,000 mPas (10% aqueous solution, 80° C., Brookfield RVT) and a substitution degree of from 0.05 to 1.0.

12 Claims, No Drawings

SIZING AGENT AND PROCESS FOR THE MANUFACTURE THEREOF

Warp yarns are provided prior to weaving with solutions, oilings, dispersions or emulsions of sizing agents which provide the yarn with smoothness, compactness, flexibility and strength, so that the processing on the loom is improved. The sizing agent is removed again in most cases after the weaving.

It is known to utilize as basic sizing substances native or modified starches, cellulose ether such as carboxymethyl celluloses, protein products, polyvinyl alcohols, polyacrylates and others. Cotton and regenerated cellulose are primarily treated with sizes based on natural substances, while mixed yarns and synthetic yarns are mainly sized with semi- or fully synthetic products used also in combination with said natural substances.

A distinction is made between two groups of sizing agents based on their removability from the fiber:

(a) Sizes which can be removed again only after being acted upon by enzymes or chemicals by subsequent washing out with water;

(b) Sizes which can be removed by being simply washed out with water.

As rationalization increases, the latter group of sizing agents which can be washed out with water gains more and more in significance. In this case, particularly substituted starches, carboxymethyl cellulose, polyvinyl alcohol and polyacrylates are used. These products are advantageously utilized under the aspect of easy removability from the fabric. However, almost without exception, said semi-synthetic or fully synthetic sizing agents show very poor biological degradability, which is reflected by a biological oxygen requirement, though only low, but a high chemical oxygen requirement.

Sizing agents based on polysaccharides found in nature such as, for example, starch sizes, are known for their good biological degradability, however, said agent are unsuitable or only insufficiently suitable for the sizing of semi-synthetic or fully synthetic fibers. Said agents are therefore preferably utilized in mixture with said agents.

Attempts have already been made to fall back on other natural sizing agents by varying the polysaccharide component. For example, also the meal of Tamarindus Indica, the so-called Tamarind seed meal, has been specified as a sizing agent (Whistler Industrial Gums, 461 ff, Melliand, 1956, 588 ff). However, the utilization of such sizing agents is nearly exclusively limited to the Indian subcontinent, because the shortcomings of the Tamarind kernel sizing agent blocked its wider utilization.

Now, the present invention relates to a sizing agent with good biological degradability which can be washed out with water and that is characterized by excellent adhesive power and flexibility.

According to the invention it was found that the polysaccharide from the seed of *Cassia occidentalis,* after hydroxyalkylation and partial depolymerization, is an excellent sizing agent for yarns made of cotton, regenerated cellulose and synthetic fibers as well as their mixtures.

Therefore, the object of the invention is a sizing agent for yarns made of cotton, regenerated cellulose and synthetic fibers as well as their mixtures, which sizing agent is substantially composed of a hydroxyalkylated polysaccharide from the seed of *Cassia occidentalis,* said polysaccharide having a viscosity of from 40 to 10,000 mPas (10% aqueous solution, 80° C., Brookfield RVT) and a substitution degree of from 0.05 to 1.0.

The sizing agents according to the invention, in aqueous solution with a 10% content of dry substance, have a viscosity range of 40 to 10,000 mPas, preferably 200 to 9,000 mPas. The viscosity is measured at 80° C. with a Brookfield viscosimeter model RVT with 20 r.p.m.

The hydroxyalkylated polysaccharides utilized according to the invention as sizing agents have a degree of substitution of from 0.05 to 1.0, preferably from 0.1 to 0.9.

Preferred is hydroxyethylated and hydroxypropylated polysaccharide although hydroxy-$C_{2-4}$-alkylated polysaccharide can be basically utilized.

The polysaccharide from *Cassia occidentalis* utilized according to the invention is mainly a galactomannan.

The sizing agents according to the invention are produced by hydroxyalkylating in the manner known per se polysaccharide from the endosperms of *Cassia occidentalis* with an alkylene oxide or halogen alkanol, and depolymerizing said polysaccharide in the known manner either prior to or during or after the hydroxyalkylation for achieving the desired viscosity. The depolymerization may be carried out, for example with hydrogen peroxide or with inorganic peroxides, or by hydrolysis or by means of enzymes.

In a preferred process, the polysaccharide from the endosperms of *Cassia occidentalis* is first briefly admixed in a kneader/mixer with aqueous NaOH-solution, the mixture is subsequently admixed with an alkylene oxide, preferably such as ethylene oxide or propylene oxide, and thoroughly blended for a number of hours in a closed mixer at a temperature of from 40° to 80° C. After the reaction is completed, the depolymerization is carried out with an aqueous hydrogen peroxide solution at an elevated temperature, for example in the range of 50° and 90° C. Said depolymarization may also be carried out prior to the hydroxyalkylation. The almost homogeneous paste so obtained may subsequently be dried, for example in a roller dryer. A product is obtained which is soluble in cold and hot water.

The sizing agent according to the invention is practically free of salt and neither represents a salt in its molecular structure such as, for example, the carboxymethylates or polyacrylates. Saltless sizing agents are known to protect the weaving gear and to cause no corrosion.

As compared to the saltfree starch sizes the products according to the invention have the advantage of considerably superior sizing effects. As compared to the saltfree sizes based on CMC, PVA or acrylate the sizing agent according to the invention has good biological degradability and can be readily removed from waste water in a biologically working treatment plant. Furthermore, contrary to polyvinyl alcohol it is readily soluble also in the alkaline medium.

Therefore, it combines all the good properties of the known sizing agents without having their drawbacks.

By utilizing the sizing agents according to the invention it is achieved that the yarns sized with said agents have a good surface smoothness owing to the excellent elasticity and good film-forming capability of said agents, and that said yarns have thus sufficient resistance to the high stresses of the weaving process. This applies in particular to fabrics adjusted to very high density.

Additional advantages are gained for the further processing due to the easy removability of the size from the fabric by merely washing out the size with water: a time-consuming and costly enzymatic desizing, for example, is no longer required.

The sizing agent according to the invention has good biological degradability. The chemical oxygen requirement of such a size solution drops after 5 days of incubation with activated sludge to less than 20% of the initial value. Comparisons with the conventionally utilized sizing agents capable of being washed out with water show that polyvinyl alcohol, polyacrylates and carboxymethyl cellulose are practically not subject to degradation under said conditions.

The invention is explained by the following examples; all parts are parts by weight.

EXAMPLE 1

100 parts polysaccharide from endosperms of *Cassia occidentalis* is placed in a kneader/mixer and admixed in the operating mixer within 5 minutes with a solution of 1 part hydrochloric acid (about 32% conc.) in 80 parts water. Degradation is permitted under thorough mixing for another 60 minutes at about 60°-80° C. Subsequently, a solution of 6.5 parts sodium hydroxide in 50 parts water is added within 30 minutes and mixing is continued for another 30 minutes at said temperature (60°-80° C.). The mixture is subsequently admixed with 15 parts propylene oxide and the mixer is then tightly sealed. The reaction period is completed after 3 hours kneading at 60° C. (product temperature). The excess propylene oxide is then removed by vacuum and the reaction material admixed with 5 parts hydrogen peroxide (abt. 32% conc.) in 500 parts water and kneaded for approximately 90 minutes at 60°-90° C. The paste is then homogeneous and is dried in a thin layer with a roller dryer.

The scaly product sizing agent is soluble in cold and hot water; the 10% aqueous solution has a viscosity of about 7000 to 8500 mPas at 80° C. The sizing agent has a substitution degree of 0.27.

EXAMPLE 2

100 parts polysaccharide from endosperms of *Cassia occidentalis* is placed in a kneader/mixer and admixed in the operating mixer within about 5 minutes with a solution of 40 parts hydrogen peroxide (32%) in 60 parts water. Maturing is permitted for another 30 minutes while thoroughly blending the mixture. A solution of 8 parts sodium hydroxide in 50 parts water is then added within about 30 minutes and agitation continuted for another 90 minutes at 80° C. The excess hydrogen peroxide is eliminated up to the negative detection of $H_2O_2$ within 30 minutes at 80° C. by means of a solution of 8-12 parts sodium sulfite in 60 parts water.

The mixture is subsequently admixed with 15 parts propylene oxide and the mixer is then tightly sealed. The reaction is completed after 3 hours kneading at 60° C. (product temperature). The excess propylene oxide is then removed by vacuum. The highly swollen splits are admixed with 400 parts water and kneaded for 60 minutes at 60°-90° C. The light, nearly homogeneous paste is dried in a thin layer in a roller dryer.

The scaly sizing agent is soluble in cold and hot water; its 10% solution has a viscosity of about 1000 mPas at 80° C. The substitution degree was determined to be 0.25 (iodine-hydrogen method).

EXAMPLE 3

100 parts polysaccharide from endosperms of *Cassia occidentalis* was placed in a kneader/mixer and blended within about 5 minutes in the running mixer with a solution of 5 parts sodium hydroxide in 100 parts water. After 30 minutes of kneading the mixture is mixed with 45 parts propylene oxide and the mixer is tightly closed. The reaction material is permitted to react for another 3 hours under thorough blending at 60° C. (product temperature). The excess propylene oxide is then removed by vacuum, the reaction mass blended with 50 parts hydrogen peroxide (32%) in 500 parts water and kneaded for about 90 minutes at 60°-90° C. Then nearly homogeneous paste is dried in a thin layer on a roller dryer.

The scaly sizing agent is soluble in cold and hot water; its 10% solution has a viscosity of about 700 mPas at 80° C. The degree of substitution was determined to be 0.7 (iodine-hydrogen method).

EXAMPLE 4

100 parts meal from the endosperms of *Cassia occidentalis* was placed in a kneader/mixer and blended within about 5 minutes in the running mixer with a solution of 5 parts sodium hydroxide in 30 parts absolute methanol. After 30 minutes of kneading the mixture is blended with 10 parts propylene oxide and the mixer is tightly sealed. The reaction mass is permitted to react for another 3 hours at 60° C. (product temperature) while being thoroughly blended. The methanol as well as the excess propylene oxide are then removed and the reaction mass blended with 50 parts hydrogen peroxide (32%) in 500 parts water and kneaded for about 30 minutes at 60°-90° C. The homogeneous paste is dried in a thin layer on a roller dryer. The scaly sizing agent is soluble in cold and hot water. The 10% aqueous solution has a viscosity of about 500 mPas at 80° C. The substitution degree was determined to be 0.15.

EXAMPLE 5

100 parts polysaccharide from endosperms of *Cassia occidentalis* is placed in a kneader/mixer and blended in the running mixer within about 5 minutes with a solution of 5 parts sodium hydroxide in 100 parts water. After 30 minutes of kneading the mixture is blended with 15 parts ethylene oxide and the mixer is sealed. The reaction mass is permitted to react for another 3 hours at 60° C. (product temperature) while being thoroughly blended. The excess ethylene oxide is then removed by vacuum, the reaction material mixed with 50 parts hydrogen peroxide (32%) in 500 parts water and kneaded for about 90 minutes at 60°-90° C. The homogeneous paste is dried in a roller dryer.

The scaly sizing agent is soluble in cold and hot water its 10% aqueous solution has a viscosity of about 800 mPas at 80° C. The substitution degree was determined to be 0.3 (iodine-hydrogen method).

EXAMPLE 6

100 parts meal from the endosperms of *Cassia occidentalis* is placed in a kneader/mixer and mixed in the running mixer within about 5 minutes with a solution of 5 parts sodium hydroxide in 30 parts absolute methanol. After 30 minutes of kneading the mixture is blended with 15 parts ethylene oxide and the mixer is sealed. The reaction material is permitted to react for another 3 hours at 60° C. (product temperature) while being thoroughly blended. The excess ethylene oxide is subsequently removed (vacuum), the reaction material mixed with 50 parts hydrogen peroxide (32%) in 50 parts absolute methanol and kneaded for about 90 minutes at 60°-90° C. After drying in vacuum a powdery sizing agent is obtained which is soluble in cold and hot water. The 10% aqueous solution of the sizing agent has a viscosity of about 1200 mPas at 80° C. The substitution degree was determined to be 0.25 (iodine-hydrogen method).

EXAMPLE 7

100 parts endosperms of *Cassia occidentalis* was placed in a kneader/mixer and blended in the running mixer within 5 minutes with a solution of 10 parts hydrochloric acid (32%) in 80 parts water. Degradation is permitted to take place for another 60 minutes at about 60°-80° C. while the mixture is thoroughly blended. Subsequently, a solution of 10 parts sodium hydroxide in 50 parts water is added within about 30 minutes and agitation is continued for another 30 minutes at said temperature (60°-80° C.). The highly swollen but still well-flowing endosperms of *Cassia occidentalis* are subsequently mixed with 8 parts propylene oxide and the mixer is then tightly sealed. The reaction is completed after 3 hours of kneading at 60° C. The excess propylene oxide is then removed by vacuum, the reaction material mixed with 35 parts hydrogen peroxide (32%) in 35 parts water and kneaded for about 90 minutes at approximately 50° C. The highly swollen but still flowing sizing agent is ground in a mill while being dried at the same time. The 10% aqueous solution of the product has a viscosity of about 200 mPas at 80° C. The substitution degree was determined to be 0.1 (iodine-hydrogen method).

EXAMPLE 8

100 parts endosperms of *Cassia occidentalis* is loaded in a kneader/mixer and blended in the running mixer within about 5 minutes with a solution of 5 parts sodium hydroxide in 100 parts water. After 30 minutes of kneading the mixture is mixed with 15 parts ethylene oxide and the mixer is sealed. The reaction material is permitted to react for another 3 hours at 60° C. while being thoroughly blended. The excess ethylene oxide is subsequently removed (vacuum), the reaction material mixed with 50 parts hydrogen peroxide (32%) in 50 parts water and kneaded for about 90 minutes at 60°-90° C. The highly swollen but still flowing product is ground in a mill while being dried. The 10% aqueous solution of the sizing agent shows at 80° C. a viscosity of 600 mPas. The substitution degree was found to be 0.85 (iodine-hydrogen method).

EXAMPLE 9

40 kg of the sizing agent as defined in example 7 is mixed in a turbo-boiler with 450 liters cold water and boiled up. The following material was sized on a drum sizing machine:

Nm 30/1 polyester/cotton with a mixing ratio of 50%:50%, raw white, 4,456 filaments, intended for cord fabric with fabric adjustment 27/54-30/20.

The temperature in the sizing vat was constantly maintained at 85° C. The warp was once dipped into the mixture and squeezed twice, achieving a squeezing effect of 115%. The warp was processed on automatic Sulzer looms with a weaving efficiency around 98.0%. 0.005 warp breaks were calculated per 1000 warps and 10,000 wefts.

The comparative test with a sizing product prepared from soluble starch and CMC with a size formulation of 60 kg per 500 liters finished solution yielded a weaving efficiency of 95.6%.

EXAMPLE 10

8 kg sizing agent as defined in example 1 and 0.5 kg sizing fat were used to prepare 350 liters finished solution in a pressure boiler. The solution was used to size the following warp material:

Nm 40/1 regenerated cellulose, 2,096 filaments. The fabric adjustment was composed of warp and weft, Nm 40/1 each, and 20 filaments per cm each.

The warp was sized on a drum sizing machine; the yarn was twice dipped into the sizing vat and twice squeezed out. The temperature of the sizing solution was 90° C. A squeeze-out effect of 124% was achieved. The weaving efficiency with the warps so sized was 97.8%, which corresponded with 0.015 warp breaks based on 1000 warps and 10,000 wefts.

A counter test with a combination size composed of carboxymethylated starch and polyacrylate and with a size concentration of 9 kg per 350 liters finished sizing solution yielded a weaving efficiency of 96.2%.

EXAMPLE 11

450 liters finished sizing solution was prepared in a pressure boiler from 35 kg sizing agent as defined in example 2 and 1.5 kg sizing fat.

The following warp material was sized:

Nm 64/1 polyester/cotton with a mixing ratio of 50%:50%, with 5,024 filaments in the 34/25-64/64 fabric adjustment.

A drum sizing machine with 9 drying cylinders was available as the sizing machine. The temperature of the sizing solution was 80° C. The warp was dipped twice into the solution and twice squeezed out with a squeeze-out effect of 129%. An efficiency of 97.1% was achieved in the weaving mill. The amount of dust produced both in the dry zone of the sizing machine and in the weaving mill was extremely low.

The counter test with 45 kg CMC with low salt content per 450 liters finished sizing solution yielded in the weaving mill an efficiency of 96.6%.

EXAMPLE 12

500 liters finished sizing solution was prepared in the turboboiler with 25 kg sizing agent as defined in example 3 and 1.0 kg sizing wax. The following warp material was sized on a drum sizing machine:

Nm 10/1 polyacrylnitrile yarn 100% with 2400 filaments and a fabric adjustment of 17/17 filaments per cm, yarn No. Nm warp and Nm weft 10/1 each The temperature of the sizing solution in the sizing vat was 80° C. The warp yarn was dipped twice and squeezed out twice, with 124% solution carried along. The warp was woven on Jaquard looms to produce fabric for drapes. The efficiency came to 0.0 warp breaks based on 1000 warps and 10,000 wefts.

The counter test was carried out with 25 kg polyvinyl alcohol per 500 liters finished sizing solution, with a weaving efficiency of 0.024 warp breaks based on 1000 warps and 10,000 wefts.

EXAMPLE 13

A warp material of

Nm 16/1 regenerated cellulose 100% with 2,060 filaments, fabric adjustment 17/14 filaments per cm, yarn No. warp Nm 16/1, weft Nm 16/1 was sized on a drum sizing machine with a sizing solution of 6 kg sizing agent as defined in example 6 and 0.5 kg sizing fat per 500 liters finished sizing solution. The temperature of the solution was constantly maintained at 85° C. in the vat. The warp yarn was once dipped into the solution and squeezed out twice with a squeeze-out effect of 131%. The warp yarn was dried to 6.5 residual moisture. The machine speed was 65 m/min. A weaving efficiency of 95.2% was achieved in the mill with the warp so sized, with an extremely low amount of dust produced. Said efficiency corresponds with 0.018 warp ruptures per 1000 warps and 10,000 wefts.

The counter test was carried out with 25 kg medium-viscous polyvinyl alcohol per 500 liters finished sizing solution, with a weaving efficiency of 95.3%.

EXAMPLE 14

450 liters finished sizing solution was prepared in a turboboiler from 35 kg sizing agent as defined in example 5 and 0.5 kg sizing fat. The following warp material was sized:

Nm 70/1 cotton, intended for Inlett fabric, with 6580 filaments in fabric adjustment 47/42-70/70.

The sizing machine was a drum sizing machine with 9 drying cylinders and 2 sizing vats. The temperature of the sizing solution during sizing was 80°-85° C. The warp yarn was twice dipped into the solution and twice squeezed out with a squeeze-out effect of 134%. An efficiency of 97.8% was achieved in the weaving mill, which corresponds with 0.01 warp ruptures per 1000 warps and 10,000 wefts.

The counter test with 35 kg CMC with low salt content per 450 liters finished sizing solution yielded in the mill an efficiency of 96.2%.

What is claimed is:

1. A process for treating yarns made of fiber selected from the group consisting of cotton, regenerated cellulose, synthetic fibers and mixtures thereof, with a water-soluble sizing agent, which comprises applying to said yarns a sizing agent comprised substantially of a hydroxyalkylated polysaccharide from the seed of *Cassia occidentalis*, said polysaccharide having a viscosity of from 40 to about 10,000 mPas (10% aqueous solution, 80° C., Brookfield RVT) and a substitution degree of 0.05-1.0.

2. A process according to claim 1, wherein the hydroxyalkylated polysaccharide is selected from the group consisting of hydroxyethylated polysaccharides and hydroxypropylated polysaccharides.

3. A process according to claim 1 wherein the hydroxyalkylated polysaccharide has a viscosity of from about 200 to about 9,000 mPas (10% aqueous solution, 80° C., Brookfield RVT).

4. A process according to claim 1 wherein the hydroxyalkylated polysaccharide has a substitution degree of from 0.1 to about 0.9.

5. A method for preparing a water-soluble sizing agent which comprises hydroxyalkylating and depolymerizing the polysaccharide gum obtained from the seed of *Cassia occidentalis* to obtain a sizing agent having a viscosity of from about 40 to about 10,000 mPas (10% aqueous solution, 80° Brookfield RVT) and a substitution degree of from 0.05 to about 1.0.

6. A method according to claim 5 in which the depolymerization is carried out prior to the hydroxyalkylation.

7. A method according to claim 5 in which the depolymerization is carried out subsequent to the hydroxyalkylation.

8. A method according to claim 5 wherein the depolymerization is carried out with hydrogen peroxide.

9. A method according to claim 5 wherein the depolymerization is carried out with inorganic peroxides.

10. A method according to claim 5 wherein the depolymerization is brought about by hydrolysis.

11. A method according to claim 5 wherein the depolymerization is carried out with enzymes.

12. A process for treating yarns made of fibers selected from the group consisting of cotton, regenerated cellulose, synthetic fibers and mixtures thereof which comprises applying to said yarns a sizing agent which is comprised substantially of a hydroxyalkylated polysaccharide from the seed of *Cassia occidentalis*, said polysaccharide having a viscosity of from about 40 to about 10,000 mPas (10% aqueous solution, 80° C., Brookfield RVT) and a substitution degree of from 0.05 to about 1.0, in combination with conventional sizing agents chosen from the group of starch and its derivatives, PVA, CMC, acrylate and conventional size additives chosen from the group of fats, glues and waxes, weaving said yarns, and then removing said sizing agent from the woven yarns.

* * * * *